US005464554A

United States Patent [19]

Gu et al.

[11] Patent Number: 5,464,554

[45] Date of Patent: Nov. 7, 1995

[54] SOLID DETERGENT COMPOSITION

[75] Inventors: Ben Gu, East Brunswick; Ravi Subramanyam, North Brunswick; Tanya Clifton, Nutley, all of N.J.

[73] Assignee: Colgate-Palmolive Company, Piscataway, N.J.

[21] Appl. No.: 116,661

[22] Filed: Sep. 3, 1993

[51] Int. Cl.[6] ..... C11D 9/32; C11D 1/12

[52] U.S. Cl. ..... 252/121; 252/128; 252/130; 252/549; 252/554; 252/546; 252/544; 252/117

[58] Field of Search ..... 252/121, 128, 252/130, 549, 554, 546, 544, 117

[56] References Cited

U.S. PATENT DOCUMENTS

| | | | |
|---|---|---|---|
| 2,738,328 | 3/1956 | Morway | 252/40.5 |
| 3,228,979 | 1/1966 | Gaertner | 260/512 |
| 4,502,538 | 3/1985 | Wellington et al. | 166/252 |
| 4,574,053 | 3/1986 | Kinsman et al. | 252/134 |
| 4,695,395 | 9/1987 | Caswell et al. | 252/121 |
| 4,941,990 | 7/1990 | McLaughlin | 252/121 |
| 5,264,145 | 11/1993 | French et al. | 252/117 |
| 5,284,598 | 2/1994 | Subramanyam et al. | 252/121 |
| 5,310,508 | 5/1994 | Subramanyam et al. | 252/549 |

FOREIGN PATENT DOCUMENTS

| | | | |
|---|---|---|---|
| 1144496 | 6/1989 | Japan | C11D 1/62 |
| 1191268 | 5/1970 | United Kingdom | C11D 1/04 |

OTHER PUBLICATIONS

*The Modern Soap and Detergent Industry,* Geoffrey Martin vol. I, Section V, p. 4 (1950).

Chem Abstracts, vol. 103: 146967n; Arima et al, Studies on Soap Containg Moisturizers the Change of Water Content in the Stratum Corneum. 1985, p. 325.

Chem Abstracts, vol. 116: 46069w; Ohata et al, Liquid Skin Cleansers Containing Hydrogenated Castor Oils, Polyoxyethylene–Polyoxypropylene Block Copolymer and Higher Fatty Acid Salts, 1992.

*Primary Examiner*—Paul Lieberman

*Assistant Examiner*—Patricia L. Hailey

*Attorney, Agent, or Firm*—Martin B. Barancik; Robert C. Sullivan

[57] ABSTRACT

A solid composition comprising a. about 5 to 75 wt % soap, b. about 5 to 75 wt % of a compound of the formula i.
$$\begin{array}{l} CH_2O(CH_2CHR'O)_nR \\ | \\ CHOH \\ | \\ CH_2SO^-{}_3X^- \end{array}$$

wherein R is alkyl or alkenyl of 8 to 22 carbon atoms inclusive,

R' is hydrogen or methyl, n is an integer having an average value of 1 to 10, X is an alkali metal, ammonium or substituted ammonium cation, or ii. a long chain alkyl or alkenyl acyl ester of an isethionate salt, or iii. a mixture of i and ii.

c. about 1 to 15 wt % of a material selected from the group consisting of hardened glycerides, high molecular weight fatty acids, fatty alcohols, waxes or mixtures thereof.

11 Claims, No Drawings

SOLID DETERGENT COMPOSITION

BACKGROUND OF THE INVENTION

The search for detergent compositions which are proper cleansing agents but remain mild to the skin is a continuing quest. Increased focus has been directed to compositions which have greater quantities of synthetic detergents and lesser quantities of soap. However, the selection of the synthetic detergent is critical to the overall properties of the composition-liquid, gel or solid-with respect to not only mildness but detersive characteristics. Additionally, in respect to the physical properties of the specific delivery system, there must be a proper balancing of these characteristics with the detereive properties and mildness of the composition. The usage of various additives can have differring effects on the overall system depending inter alia on the type of synthetic detergent involved.

It has now been found that the use of a certain family of materials, including the specific material hydrogenated castor oil, as an additive in a solid composition including soap and a certain genus of synthetic detergent not only increased the mildness of the solid composition but also improved the physical properties of the solid material such as slough, use-up and hardness. Still further and as an additional surprising benefit, the usage of the family of materials brings about a significant decrease in the viscosity of the composition during processing.

SUMMARY OF THE INVENTION

In accordance with the invention, there is a solid composition comprising a. about 5 to 75 wt % soap, b. about 5 to 75 wt % of a compound of the formula i.
$$\begin{array}{l} CH_2O(CH_2CHR'O)_nR \\ | \\ CHOH \\ | \\ CH_2SO^-{}_3X^- \end{array}$$

wherein R is alkyl or alkenyl of 8 to 22 carbon atoms inclusive,

R' is hydrogen or methyl, n is an integer having an average value of 1 to 10, X is an alkali metal, ammonium or substituted ammonium cation, or ii. a long chain alkyl or alkenyl acyl ester of an isethionate salt, or iii. a mixture of i and ii.

c. about 1 to 15 wt % of a composition selected from the group consisting of hardened glycerides, high molecular weight fatty acids, fatty alcohols, waxes and mixtures thereof.

DETAILED DESCRIPTION OF THE INVENTION

The soap used in the composition is any traditional long chain alkyl carboxylate salt that has detersive action. Example of such long chain materials are those alkyl groups having from 8 to 22, preferably 10 to 20 carbon atoms such as lauric acid, myristic acid, palmitic acid, stearic acid and the like. Any of the usual soluble salt forms can be used such as alkali metal, i.e. sodium and potassium, ammonium and substituted ammonium cation such as triethylamine, triethanolamine, tris(hydroxymethylaminomethane) and the like.

Coco acid soap or mixtures of coco acid and tallow acid are preferred. A topped acid soap, that is a soap wherein most of the lower end of the distribution of alkyl chain length have been removed can also be employed with facility. It is preferred to have about 15 to 60 wt % of the composition as soap.

The synthetic detergent component b of the composition provides additional detergency to the composition. In b(i) R is preferably 10 to 20 carbon atoms and alkyl, preferably normal. R' is preferably hydrogen. The parameter n is preferably an integer having an average value of 1 to 4, more preferably 1. X is a cation and has the same scope that the cation of a soap would normally have. In component b(ii) the hydrocarbon group is generally 8 to 22 carbon atoms, preferably 10 to 20 carbon atoms in length. Alkyl is preferred, normal alkyl is more preferred. The salt cations can be any of those mentioned for the soap. Sodium is preferred. Examples of the acyl groups are tallow, coco, palmitic, stearic and the like. The preferred b(ii) component is sodium cocoylisethionate. Component b is preferably present in the composition in quantities of about 6 to 60 wt %.

Component c provides increased mildness and greater structural strength to the solid composition. Hydrogenated castor oil, the preferred composition, is an esterified glycerol, i.e. triglyceride. It preferably melts above 80° C. and has a low iodine value, generally less than or equal to 8, preferably less than or equal to 5, indicative of its low olefinic content. The major fatty acid component of the triglyceride ester, approximately 80–90 wt %, is hydroxy stearic acid. Low levels of keto stearic acid can also be present. The component c is preferably present in quantities of about 2 to 8 wt % of the composition.

Examples of other hardened triglycerides include hydrogenated oils such as soybean oil, fish oil and tallow. High molecular weight fatty acids are those having an average minimum of $C_{22}$, preferably an average minimum of $C_{26}$ or higher. The maximum number of carbon atoms is at least somewhat dependent upon the processing constraints of the system. Waxes such as paraffin wax, beeswax and ester wax, for example, can be employed. Fatty alcohols such as tallow alcohol, stearyl alcohol or alcohols with a chain length $C_{16}$ to $C_{28}$ can be employed.

Other materials can be in the composition which are normally found in such formulations such as long chain free fatty acids (superfatting) of $C_{20}$ or less, glycerin, inorganics such as salt, antioxidants, chelating agents, opalescents, fragrances and the like.

The quantity of free fatty acid, when present, can vary from about 1 to 30 wt % of the composition, preferably about 5 to 25 wt %.

In a combar, component a is preferably about 50 to 75 wt %, and b is preferably about 6 to 30 wt % of this composition. In a syndet solid composition, component a is preferably about 6 to 30 wt %, and b is preferably about 30 to 70 wt % of this composition.

The irritation potential of the composition is measured by the in vitro collagen assay. The relationship between irritancy, particularly erythema, and collagen swelling is established and set forth in J. C. Blake—Haskins et al, J. Soc Cosmet. Chem, 37,199,1986).

In the example below the collagen film is placed in 1% solution of detergent bar formula, which is labelled with radioactive tritiated water. The solution containing collagen film is incubated at 50C. for 24 hours. After rinsing the uptake of tritiated water by the collagen film is determined by counting. The swelling of the collagen film is defined as microliter of water uptake per milligram collagen (ul/mg). For more information the journal article noted above is appropriate. The higher the water uptake, the greater is the irritation potential.

Below are the formulations used in the testing (Table 1 ). The results of the mildness testing are shown in Table 2. The physical testing, when in bar form, is shown in Table 3. Hydrogenated castor oil is designated throughout as HCO. All quantities are in weight percent of the composition.

TABLE 1

| | With HCO | Control |
|---|---|---|
| Coconut Oil Soap (Topped or normal) | 57.81 | 62.41 |
| NEGS-45-1* | 15.00 | 15.00 |
| Topped coco fatty acid | 7.00 | 7.00 |
| Hydrogenated castor oil | 5.00 | 0.00 |
| Free (organic) oil | 2.04 | 2.04 |
| Glycerin | 1.30 | 1.40 |
| Sodium chloride | 1.20 | 1.20 |
| EDTA | 0.03 | 0.03 |
| BHT | 0.02 | 0.02 |
| Titanium dioxide | 0.50 | 0.50 |
| Fragrance | 1.50 | 1.50 |
| Moisture | 8.60 | 8.90 |

*Sodium exthoxylated alcohol ($C_{14-15}$) glyceryl sulfonate with an average number of ethoxy groups of 1.

TABLE 2

In-Vitro Collagen Swelling Assay of Combars with HCO:

| Formula (1% solution) | Collagen Swelling (ul/mg) |
|---|---|
| Coconut soap/15% NEGS*/5% HCO | 10.84 +/– 0.17 |
| Coconut soap/15% NEGS* | 11.61 +/– 0.33 |
| Topped coconut soap/15% NEGS*/5% HCO | 13.07 +/– 0.43 |
| Topped coconut soap/15% NEGS* | 13.88 +/– 0.08 |

*Sodium ethoxylated alcohol ($C_{14-15}$) glyceryl sulfonate with an average number of ethoxy groups of 1.

The results indicate that addition of 5 wt % hydrogenated castor oil to a composition containing 15 wt % sodium alkyl ethoxylated alcohol ($C_{14-15}$) glyceryl sulfonate and soap increases the mildness benefits.

Additionally as shown below, the addition of hydrogenated castor oil clearly provides physical benefits to the bar with respect to bar slough, use-up and hardness.

TABLE 3

| | With HCO | Control |
|---|---|---|
| Slough (gm) | 24.2 | 35.9 |
| Use-up (%) | 23.4 | 33.3 |
| Hardness (mm) | 2.87 | 3.72 |

A synthetic detergent bar using sodium cococyl isethionate (SCI), soap and free fatty acids were prepared with and without HCO (Table 4). These bars were then tested for physical properties (Table 5).

TABLE 4

| Example | Control (Wt %) | With HCO (Wt %) |
|---|---|---|
| SCI | 48.76 | 46.43 |
| Coco fatty acid | 7.44 | 7.09 |
| Stearic acid | 16.99 | 16.18 |

TABLE 4-continued

| Example | Control (Wt %) | With HCO (Wt %) |
|---|---|---|
| Sodium tallowate | 12.47 | 11.88 |
| Sodium cocoate | 2.20 | 2.10 |
| Moisture | 5.52 | 5.87 |
| Fragrance | 1.50 | 1.50 |
| $TiO_2$ | 0.50 | 0.50 |
| Palmolive Oil Mixture | 1.00 | — |
| Hydrogenated Castor Oil | — | 5.00 |
| Miscellaneous | 3.62 | 3.45 |

TABLE 5

Physical Properties of SCI Syndet Bars

| Example | Control | With HCO |
|---|---|---|
| Slough (g) | 31.71 | 23.52 |
| Use-Up (%) | 35.91 | 34.56 |
| Hardness (mm) | 3.69 | 3.36 |

In Syndet bars, those bars containing a high level of synethetic detergent, bar slough is a major problem. As demonstrated by the data above, this problem is significantly minimized by the addition of component c hydrogenated castor oil.

The preparation of a personal care composition requires proper formulation and mixing. In the handling and processing, viscosity control is very important. Reducing the viscosity of the preparation brings about capital investment and power savings as well as additional ease of handling. As shown in the test system disclosed below, the usage of hydrogenated castor oil brings about a significant viscosity reduction to the inventive compositions.

Equipment: Brabender Plastic - Corder Torque Rheometer (Model PL-2000)
Parameters: Mixer Measuring Head - Sigma H. blade 650 ml bowl
Speed - 120 rpm
Mixer temperature - 185° F.
Sample Size - 400 g
Test time - 25 minutes Procedure 1. Accurately weighed SCI flake, stearic acid and palmolive oil mixture/hydogenated castor oil are mixed in 1000ml beaker.

2. The mixture is added into the mixer, which is preheated at 185° F.

3. After 6 minutes mixing soap is added and continuously mixed for 19 minutes.

4. The torque vs. time and temperature vs. time are measured. Results are simultaneously recorded by the computer.

Calculation $$\text{Viscosity} = \frac{\text{shear stress}}{\text{shear rate}} = K_1 \frac{\text{Torque}}{\text{RPM}}$$

$K_1$ = 162 (depends upon equipment measurements)

Below is the composition of the formulations in grams:

TABLE 6

| | Mixing formulas | | | |
|---|---|---|---|---|
| | A | B | C | D |
| SCI flake | 297.664 | 297.664 | 288.552 | 303.740 |
| Stearic acid | 9.188 | 9.188 | 8.908 | 9.376 |
| Palmolive oil | 4.000 | — | — | — |
| HCO | 4.000 | 8.000 | 20.000 | — |
| Soap | 85.148 | 85.148 | 82.540 | 86.884 |

Viscosity data was obtained by the above procedure.

TABLE 7

| | Viscosity Date | | | |
|---|---|---|---|---|
| Example | A | B | C | D |
| Temperature (°F.) | 184 | 181 | 180 | 181 |
| Viscosity (Poise) | 46.44 | 34.56 | 25.92 | 59.33 |
| Reduction (%) | 22% | 42% | 56% | — |

As is readily observed, the presence of the HCO brings about a substantial reduction in viscosity of the formulation.

We claim:

1. A solid composition comprising a. about 5 to 75 wt % soap, b. about 5 to 75 wt % of a compound of the formula i.
$$\begin{array}{l} CH_2O(CH_2CHR'O)_nR \\ | \\ CHOH \\ | \\ CH_2SO^-{}_3X^- \end{array}$$

wherein R is alkyl or alkenyl of 8 to 22 carbon atoms inclusive,

R' is hydrogen or methyl, n is an integer having an average value of 1 to 10, X is an alkali metal, ammonium or substituted ammonium cation, or ii. a long chain alkyl or alkenyl acyl ester of an isethionate salt, or iii. a mixture of land ii, c. about 1 to 15 wt % of a material selected from the group consisting of hardened glycerides, high molecular weight fatty acids, fatty alcohols, waxes or mixtures thereof.

2. The composition in accordance with claim 1 wherein c is hydrogenated castor oil.

3. The composition in accordance with claim 2 wherein a is from about 15 to 60 wt. %, b is from about 5 to 60 wt. %, and c is from about 2 to 10 wt. %.

4. The composition in accordance with claim 2 wherein R is about 10 to 20 carbon atoms and is alkyl, R' is hydrogen, n is an integer one to four.

5. The composition in accordance with claim 2 wherein in ii the acyl ester is an alkyl of 10 to 20 carbon atoms.

6. The composition in accordance with claim 2 wherein b is i.

7. The composition in accordance with claim 3 wherein b is iii.

8. The solid composition in accordance with claim 1 wherein b is i.

9. The solid composition in accordance with claim 8 wherein c is hydrogenated castor oil.

10. A process for reducing viscosity during processing of a composition comprising a. about 5 to 75 wt % soap, and b. about 5 to 75 wt % of a compound of the formula i.
$$\begin{array}{l} CH_2O(CH_2CHR'O)_nR \\ | \\ CHOH \\ | \\ CH_2SO^-{}_3X^- \end{array}$$

which comprises adding to a and b a viscosity reducing quantity of a hardened glyceride.

11. The process in accordance with claim 10 wherein the material is hydrogenated castor oil.

* * * * *

UNITED STATES PATENT AND TRADEMARK OFFICE

CERTIFICATE OF CORRECTION

PATENT NO. : 5,464,554

DATED : November 7, 1995

INVENTOR(S) : Ben Gu, Ravi Subramanyam, Tanya Clifton

It is certified that error appears in the above-identified patent and that said Letters Patent is hereby corrected as shown below:

Column 6, line 3, after "of a" delete remainder of claim and insert therefor:

--hardened triglyceride with the proviso that b is i or iii--

Column 6, line 20, change "3" to --2--.

Signed and Sealed this

Fourteenth Day of May, 1996

Bruce Lehman

*Attest:*

BRUCE LEHMAN

*Attesting Officer*

*Commissioner of Patents and Trademarks*